US011303051B2

(12) United States Patent
Rita et al.

(10) Patent No.: US 11,303,051 B2
(45) Date of Patent: Apr. 12, 2022

(54) DUAL CIRCUIT CARD PLUGGABLE MODULE

(71) Applicant: TE Connectivity Services GmbH, Schaffhausen (CH)

(72) Inventors: Jacob Rita, Lancaster, PA (US); Christopher William Blackburn, Bothell, WA (US); Mohini C. Goel, Lancaster, PA (US)

(73) Assignee: TE CONNECTIVITY SERVICES GmbH, Schaffhausen (CH)

( * ) Notice: Subject to any disclaimer, the term of this patent is extended or adjusted under 35 U.S.C. 154(b) by 0 days.

(21) Appl. No.: 16/933,288

(22) Filed: Jul. 20, 2020

(65) Prior Publication Data

US 2022/0021137 A1 Jan. 20, 2022

(51) Int. Cl.
*H01R 12/53* (2011.01)
*H01R 12/72* (2011.01)

(52) U.S. Cl.
CPC ..... *H01R 12/53* (2013.01); *H01R 12/721* (2013.01)

(58) Field of Classification Search
CPC ..... H01R 12/00; H01R 12/53; H01R 12/721; H01R 12/7213

(Continued)

(56) References Cited

U.S. PATENT DOCUMENTS 6,585,528 B1 * 7/2003 Lin ..... H01R 9/0515 439/76.1
7,618,264 B2 * 11/2009 Wu ..... H01R 13/502 439/76.1

(Continued)

*Primary Examiner* — Peter G Leigh

(57) ABSTRACT

In one embodiment, a pluggable module is provided. The pluggable module includes a pluggable body having a top wall, a bottom wall, a first side wall and a second side wall. The pluggable body has a cavity. The pluggable body extends between a mating end and a cable end. An upper module circuit card is received in the cavity. The upper module circuit card has a mating edge at a mating end configured to be loaded into an upper card slot of a card edge connector and a cable end opposite the mating end. The upper module circuit card includes first upper contact pads on an upper surface of the upper module circuit card at the mating end. The upper module circuit card includes second upper contact pads on a lower surface of the upper module circuit card at the mating end. The upper module circuit card includes first upper cable termination areas on the upper surface of the upper module circuit card at the cable end. The upper module circuit card includes second upper cable termination areas on the lower surface of the upper module circuit card at the cable end. The first upper cable termination areas include first upper cable pads electrically connected to corresponding first upper contact pads. The second upper cable termination areas include second upper cable pads electrically connected to corresponding second upper contact pads. A lower module circuit card is received in the cavity. The lower module circuit card has a mating edge at a mating end configured to be loaded into a lower card slot of a card edge connector and a cable end opposite the mating end. The lower module circuit card includes first lower contact pads on an upper surface of the lower module circuit card at the mating end. The lower module circuit card includes second lower contact pads on a lower surface of the lower module circuit card at the mating end. The lower module circuit card includes first lower cable termination areas on the upper surface of the lower module circuit card at the cable end. The lower module circuit card includes second lower cable termination areas on the lower surface of the lower module circuit card at the cable end. The first lower cable termination areas includes first lower cable pads electrically connected to corresponding first lower contact pads. The second lower cable termination areas includes (Continued)

second lower cable pads electrically connected to corresponding second lower contact pads. Upper cables have upper cable conductors terminated to corresponding first and second upper cable pads. Lower cables having lower cable conductors terminated to corresponding first and second lower cable pads. Adjacent first upper cable termination areas are staggered relative to each other. Adjacent second upper cable termination areas are staggered relative to each other. Adjacent first lower cable termination areas are staggered relative to each other. Adjacent second lower cable termination areas are staggered relative to each other.

19 Claims, 7 Drawing Sheets

(58) Field of Classification Search
USPC ..... 439/61
See application file for complete search history.

(56) References Cited

U.S. PATENT DOCUMENTS 7,651,341 B2 * 1/2010 Wu ..... H01R 13/6335 439/76.1
7,654,831 B1 * 2/2010 Wu ..... H01R 13/6593 439/76.1
8,147,255 B2 * 4/2012 Wu ..... H01R 13/6275 439/76.1
8,187,019 B2 * 5/2012 Reed ..... H01R 24/60 439/345
8,235,731 B1 * 8/2012 Poulsen ..... H01R 13/6658 439/76.1
8,337,233 B2 * 12/2012 Wu ..... H01R 13/6593 439/345
8,360,799 B2 * 1/2013 Wu ..... H01R 13/6581 439/358
8,475,199 B2 * 7/2013 Wang ..... H01R 13/6275 439/353
8,506,331 B2 * 8/2013 Wu ..... H01R 13/6658 439/607.18
8,550,848 B2 * 10/2013 Wu ..... H01R 13/6583 439/607.18
8,708,752 B2 * 4/2014 Wu ..... H01R 9/032 439/660
8,764,491 B2 * 7/2014 Wang ..... H01R 13/659 439/660
8,770,990 B2 * 7/2014 Sytsma ..... H01R 9/034 439/76.1
8,834,185 B2 * 9/2014 Wu ..... H01R 9/2408 439/76.1
8,840,432 B2 * 9/2014 Alden, III ..... H01R 13/6585 439/607.46
8,926,339 B2 * 1/2015 Houtz ..... H01R 13/5045 439/76.1
9,142,927 B2 * 9/2015 Tseng ..... H01R 13/6278
9,306,334 B2 * 4/2016 Zhu ..... H05K 1/0219
9,331,418 B2 * 5/2016 Chung ..... H01R 24/60
9,385,466 B2 * 7/2016 Henry ..... H01R 13/506
9,627,799 B2 * 4/2017 Tseng ..... H01R 13/5825
10,103,453 B2 * 10/2018 Pao ..... H01R 13/6595
10,553,966 B1 * 2/2020 Little ..... H01R 12/596
2008/0318478 A1 * 12/2008 Nelson ..... H05K 1/142 439/620.01
2009/0197438 A1 * 8/2009 Liu ..... H01R 13/65914 439/76.1
2011/0306244 A1 * 12/2011 Zhang ..... H01R 13/65914 439/624
2012/0094515 A1 * 4/2012 Wu ..... H01R 13/6272 439/159
2019/0140374 A1 * 5/2019 Wu ..... H01R 43/0263
2020/0161781 A1 * 5/2020 Qiao ..... H01R 12/50

* cited by examiner

DUAL CIRCUIT CARD PLUGGABLE MODULE

BACKGROUND OF THE INVENTION

The subject matter herein relates generally to pluggable modules for communication systems.

Some communication systems utilize communication connectors, such as card edge connectors and pluggable modules to interconnect various components of the system for data communication. Known pluggable modules typically include a circuit card, which is electrically connected to the card edge connector. The circuit card includes a card edges that is plugged into a card slot of the card edge connector during the mating operation. Cables are typically electrically connected to the circuit card. However, the cables and the cable terminations are packaged at a tight pitch along the edge of the circuit card, leading to cross talk and signal degradation. There is a need for pluggable modules of communication systems to have improved signal integrity with greater contact density and data throughput.

BRIEF DESCRIPTION OF THE INVENTION

In one embodiment, a pluggable module is provided. The pluggable module includes a pluggable body having a top wall, a bottom wall, a first side wall and a second side wall. The pluggable body has a cavity. The pluggable body extends between a mating end and a cable end. An upper module circuit card is received in the cavity. The upper module circuit card has a mating edge at a mating end configured to be loaded into an upper card slot of a card edge connector and a cable end opposite the mating end. The upper module circuit card includes first upper contact pads on an upper surface of the upper module circuit card at the mating end. The upper module circuit card includes second upper contact pads on a lower surface of the upper module circuit card at the mating end. The upper module circuit card includes first upper cable termination areas on the upper surface of the upper module circuit card at the cable end. The upper module circuit card includes second upper cable termination areas on the lower surface of the upper module circuit card at the cable end. The first upper cable termination areas include first upper cable pads electrically connected to corresponding first upper contact pads. The second upper cable termination areas include second upper cable pads electrically connected to corresponding second upper contact pads. A lower module circuit card is received in the cavity. The lower module circuit card has a mating edge at a mating end configured to be loaded into a lower card slot of a card edge connector and a cable end opposite the mating end. The lower module circuit card includes first lower contact pads on an upper surface of the lower module circuit card at the mating end. The lower module circuit card includes second lower contact pads on a lower surface of the lower module circuit card at the mating end. The lower module circuit card includes first lower cable termination areas on the upper surface of the lower module circuit card at the cable end. The lower module circuit card includes second lower cable termination areas on the lower surface of the lower module circuit card at the cable end. The first lower cable termination areas includes first lower cable pads electrically connected to corresponding first lower contact pads. The second lower cable termination areas includes second lower cable pads electrically connected to corresponding second lower contact pads. Upper cables have upper cable conductors terminated to corresponding first and second upper cable pads. Lower cables have lower cable conductors terminated to corresponding first and second lower cable pads. Adjacent first upper cable termination areas are staggered relative to each other. Adjacent second upper cable termination areas are staggered relative to each other. Adjacent first lower cable termination areas are staggered relative to each other. Adjacent second lower cable termination areas are staggered relative to each other.

In another embodiment, a pluggable module is provided. The pluggable module includes a pluggable body having a top wall, a bottom wall, a first side wall and a second side wall. The pluggable body has a cavity. The pluggable body extends between a mating end and a cable end. An upper module circuit card received in the cavity. The upper module circuit card has a mating edge at a mating end configured to be loaded into an upper card slot of a card edge connector and a cable end opposite the mating end. The upper module circuit card includes first upper contact pads on an upper surface of the upper module circuit card at the mating end. The upper module circuit card includes second upper contact pads on a lower surface of the upper module circuit card at the mating end. The upper module circuit card includes first upper cable termination areas on the upper surface of the upper module circuit card at the cable end. The upper module circuit card includes second upper cable termination areas on the lower surface of the upper module circuit card at the cable end. The first upper cable termination areas include first upper cable pads electrically connected to corresponding first upper contact pads. The second upper cable termination areas include second upper cable pads electrically connected to corresponding second upper contact pads. Adjacent first upper cable termination areas are staggered relative to each other and adjacent second upper cable termination areas are staggered relative to each other. A lower module circuit card is received in the cavity and separated from the upper module circuit card across a card gap. The lower module circuit card has a mating edge at a mating end configured to be loaded into a lower card slot of a card edge connector and a cable end opposite the mating end. The lower module circuit card includes first lower contact pads on a lower surface of the lower module circuit card at the mating end. The lower module circuit card includes second lower contact pads on a lower surface of the lower module circuit card at the mating end. The lower module circuit card includes first lower cable termination areas on the lower surface of the lower module circuit card at the cable end. The lower module circuit card includes second lower cable termination areas on the lower surface of the lower module circuit card at the cable end. The first lower cable termination areas include first lower cable pads electrically connected to corresponding first lower contact pads. The second lower cable termination areas include second lower cable pads electrically connected to corresponding second lower contact pads. Adjacent first lower cable termination areas are staggered relative to each other and adjacent second lower cable termination areas are staggered relative to each other. Upper cables have upper cable conductors terminated to corresponding first and second upper cable pads. Lower cables have lower cable conductors terminated to corresponding first and second lower cable pads. The second upper cable termination areas are offset relative to the first lower cable termination areas across the card gap.

In a further embodiment, a communication system is provided. The communication system includes a receptacle connector assembly including a receptacle cage having a cavity and a card edge connector received in the cavity of the receptacle cage. The card edge connector includes a housing and a contact assembly received in the housing. The card edge connector includes an upper card slot and a lower card slot. Upper contacts of the contact assembly are provided in the upper card slot. Lower contacts of the contact assembly are provided in the lower card slot. A pluggable module pluggable into the cavity of the receptacle cage for mating with the card edge connector. The pluggable module includes a pluggable body having a top wall, a bottom wall, a first side wall and a second side wall. The pluggable body has a cavity. The pluggable body extends between a mating end and a cable end. The mating end is received in the receptacle cage. An upper module circuit card is received in the cavity of the pluggable body. The upper module circuit card has a mating edge at a mating end configured to be loaded into the upper card slot of the card edge connector and a cable end opposite the mating end. The upper module circuit card includes first upper contact pads on an upper surface of the upper module circuit card at the mating end. The upper module circuit card includes second upper contact pads on a lower surface of the upper module circuit card at the mating end. The first and second upper contact pads are electrically connected to corresponding upper contacts. The upper module circuit card includes first upper cable termination areas on the upper surface of the upper module circuit card at the cable end. The upper module circuit card includes second upper cable termination areas on the lower surface of the upper module circuit card at the cable end. The first upper cable termination areas include first upper cable pads electrically connected to corresponding first upper contact pads. The second upper cable termination areas include second upper cable pads electrically connected to corresponding second upper contact pads. A lower module circuit card is received in the cavity of the pluggable body. The lower module circuit card has a mating edge at a mating end configured to be loaded into the lower card slot of the card edge connector and a cable end opposite the mating end. The lower module circuit card includes first lower contact pads on a lower surface of the lower module circuit card at the mating end. The lower module circuit card includes second lower contact pads on a lower surface of the lower module circuit card at the mating end. The first and second lower contact pads are electrically connected to corresponding lower contacts. The lower module circuit card includes first lower cable termination areas on the lower surface of the lower module circuit card at the cable end. The lower module circuit card includes second lower cable termination areas on the lower surface of the lower module circuit card at the cable end. The first lower cable termination areas include first lower cable pads electrically connected to corresponding first lower contact pads. The second lower cable termination areas include second lower cable pads electrically connected to corresponding second lower contact pads. Upper cables have upper cable conductors terminated to corresponding first and second upper cable pads. Lower cables have lower cable conductors terminated to corresponding first and second lower cable pads. First upper cable termination areas are staggered relative to each other. Adjacent second upper cable termination areas are staggered relative to each other. Adjacent first lower cable termination areas are staggered relative to each other. Adjacent second lower cable termination areas are staggered relative to each other.

DETAILED DESCRIPTION OF THE INVENTION

Figure 1:
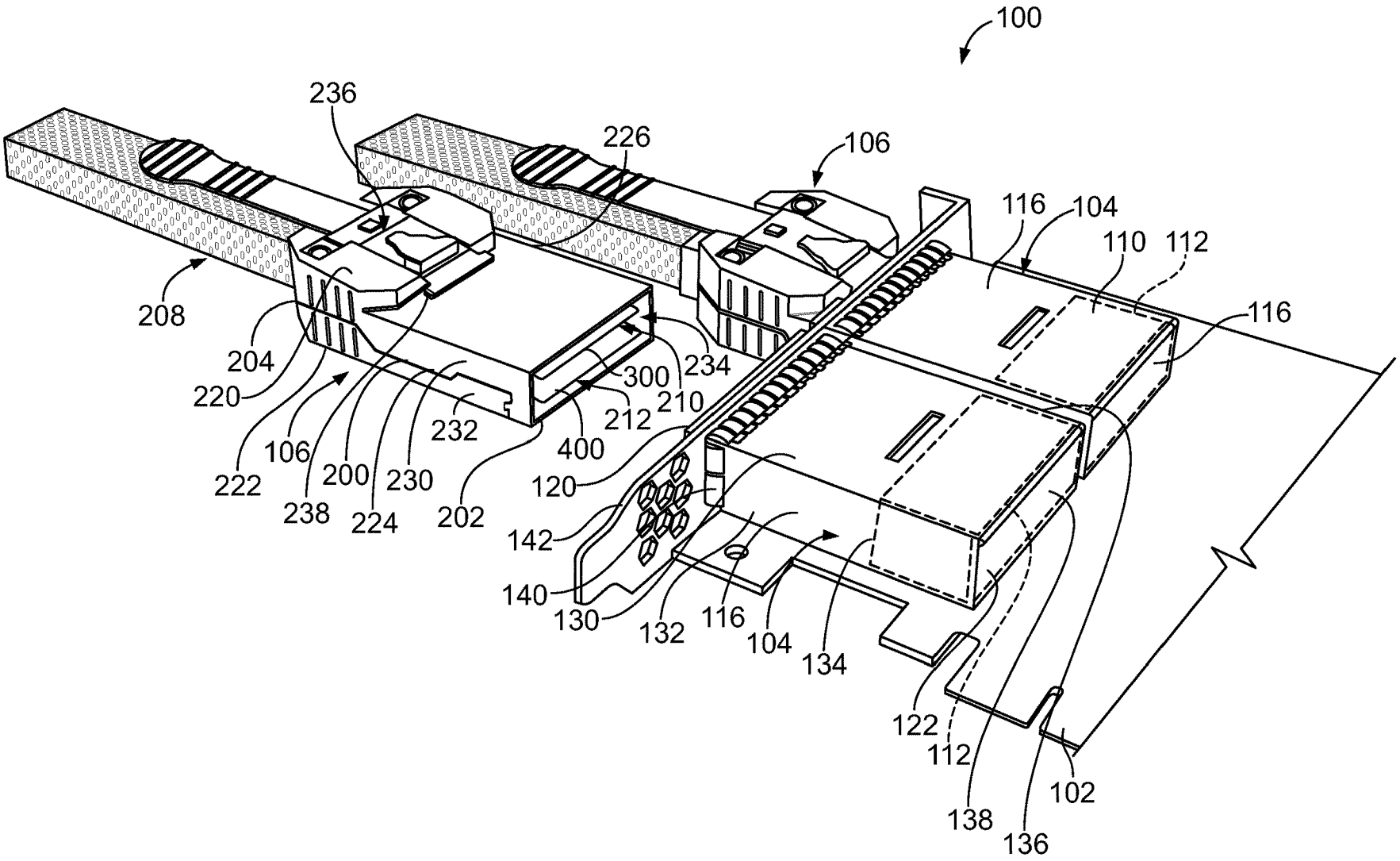
FIG. 1 is a perspective view of a communication system formed in accordance with an exemplary embodiment.
Figure 2:
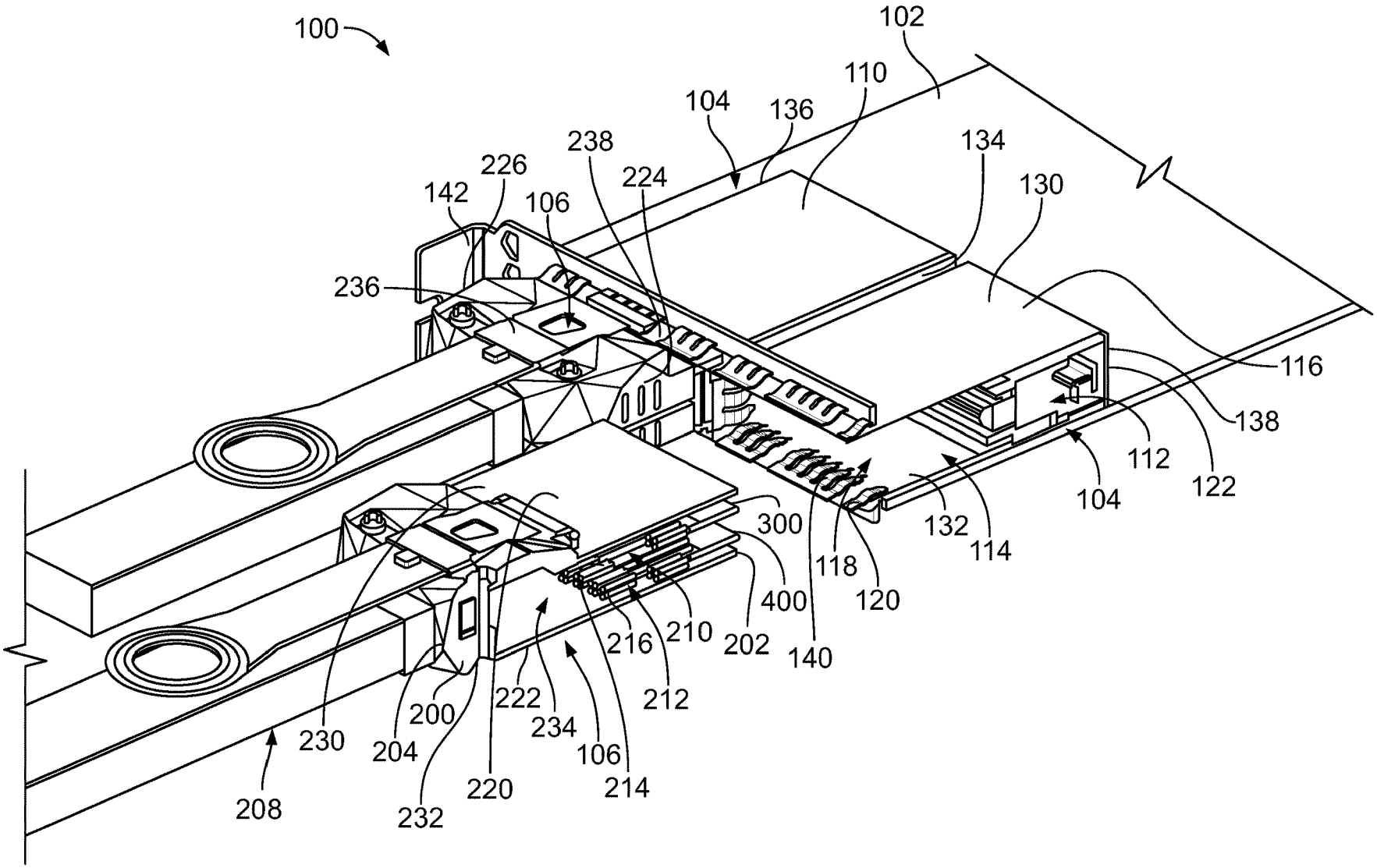
FIG. 2 is a partial sectional view of the communication system formed in accordance with an exemplary embodiment.

FIG. 1 is a perspective view of a communication system 100 formed in accordance with an exemplary embodiment. FIG. 2 is a partial sectional view of the communication system 100 formed in accordance with an exemplary embodiment. The communication system 100 includes a host circuit board 102 and one or more receptacle connector assemblies 104 mounted to the host circuit board 102. A pluggable module 106 is configured to be electrically connected to each receptacle connector assembly 104. The pluggable module 106 is electrically connected to the host circuit board 102 through the receptacle connector assembly 104.

In an exemplary embodiment, the receptacle connector assembly 104 includes a receptacle cage 110 and a card edge connector 112 (FIG. 2). The receptacle cage 110 forms a cavity 114 (FIG. 2) that receives the card edge connector 112 and the pluggable module 106. In various embodiments, the receptacle cage 110 is enclosed and provides electrical shielding for the card edge connector 112 and the pluggable module 106. In an exemplary embodiment, the receptacle cage 110 is a shielding, stamped and formed cage member that includes a plurality of shielding walls 116 that define the cavity 114. In other various embodiments, the card edge connector 112 may be located rearward of the receptacle cage 110. In other embodiments, the receptacle connector assembly 104 may be provided without the receptacle cage 110. In the illustrated embodiment, the card edge connector 112 is oriented for horizontal mating (for example, parallel to the host circuit board 102). In other various embodiments, the card edge connector 112 is oriented for vertical mating (for example, perpendicular to the host circuit board 102).

In the illustrated embodiment, the receptacle cage 110 is a single port receptacle cage configured to receive a single pluggable module 106. In other various embodiments, the receptacle cage 110 may be a ganged cage member having a plurality of ports ganged together in a single row and/or a stacked cage member having multiple ports stacked as an upper port and a lower port for receiving corresponding pluggable modules 106. The receptacle cage 110 includes a module channel 118 having a module port open to the module channel 118. The module channel 118 receives the pluggable module 106 through the module port. In an exemplary embodiment, the receptacle cage 110 extends between a front end 120 and a rear end 122. The module port is provided at the front end 120. Any number of module channels 118 may be provided in various embodiments arranged in a single column or in multiple columns (for example, 2×2, 3×2, 4×2, 4×3, 4×1, 2×1, and the like). Optionally, multiple card edge connectors 112 may be arranged within the receptacle cage 110, such as when multiple rows and/or columns of module channels 118 are provided.

In an exemplary embodiment, the walls 116 of the receptacle cage 110 include a top wall 130, a bottom wall 132, a first side wall 134 and a second side wall 136 extending from the top wall 130. The bottom wall 132 may rest on the host circuit board 102. In other various embodiments, the receptacle cage 110 may be provided without the bottom wall 132. Optionally, the walls 116 of the receptacle cage 110 may include a rear wall 138 at the rear end 122. The walls 116 define the cavity 114. The cavity 114 receives the card edge connector 112 at the rear end 122. Other walls 116 may separate or divide the cavity 114 into additional module channels 118, such as in embodiments using ganged and/or stacked receptacle cages. For example, the walls 116 may include one or more vertical divider walls and/or one or more horizontal divider walls between the module channels 118.

In an exemplary embodiment, the receptacle cage 110 may include one or more gaskets 140 at the front end 120 for providing electrical shielding for the module channels 118. For example, the gaskets 140 may be provided at the port to electrically connect the receptacle cage 110 with the pluggable modules 106 received in the module channel 118. The gaskets 140 electrically connect the receptacle cage 110 to a panel 142 (FIG. 1). The gaskets 140 may include spring fingers or other deflectable features.

Optionally, the receptacle connector assembly 104 may include one or more heat sinks (not shown) for dissipating heat from the pluggable modules 106. For example, the heat sink may be coupled to the top wall 130 for engaging the pluggable module 106 received in the module channel 118. The heat sink may extend through an opening in the top wall 130 to directly engage the pluggable module 106. Other types of heat sinks may be provided in alternative embodiments.

Figure 3:
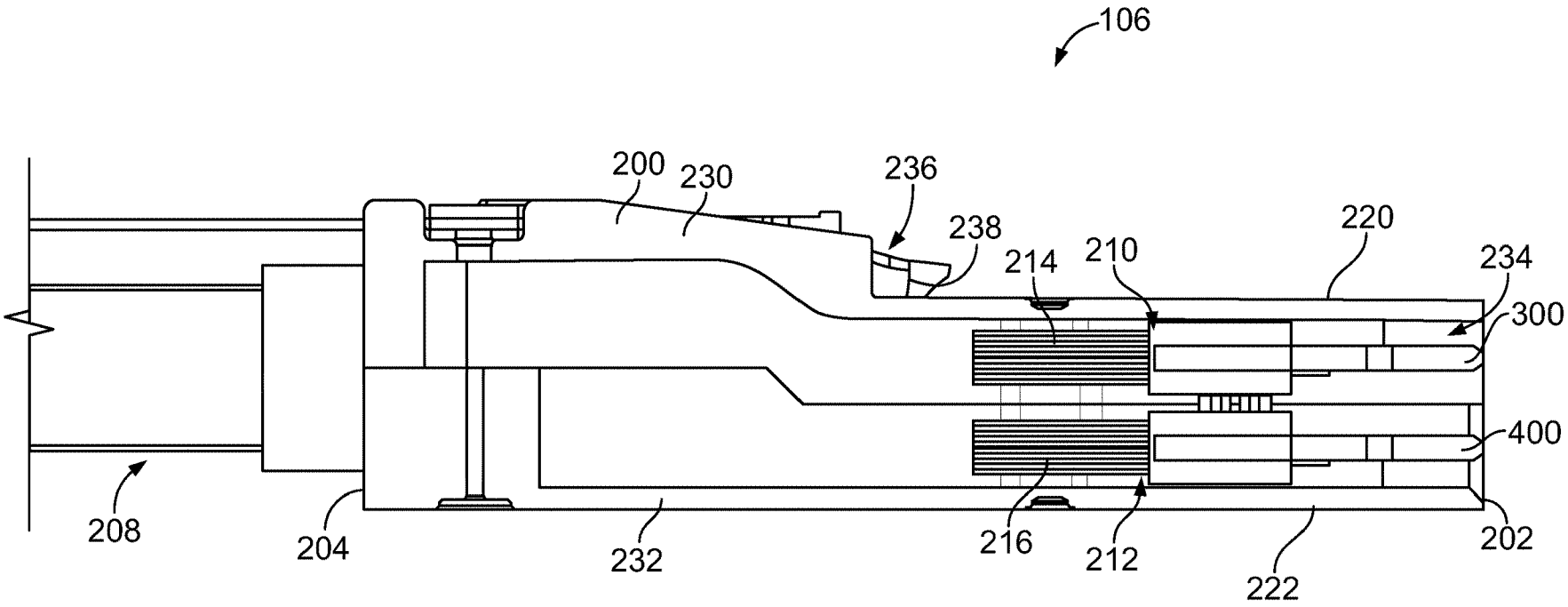
FIG. 3 is a cross sectional view of the pluggable module in accordance with an exemplary embodiment.

With additional reference to FIG. 3, which is a cross sectional view of the pluggable module 106, in an exemplary embodiment, the pluggable module 106 is a dual circuit card module. The pluggable module 106 includes a cable assembly 208, such as an upper cable assembly 210 and a lower cable assembly 212. The upper cable assembly 210 includes upper cables 214. The lower cable assembly 212 includes lower cables 216. The upper cable assembly 210 includes an upper module circuit card 300. The lower cable assembly 212 includes a lower module circuit card 400. The upper and lower module circuit cards 300, 400 are configured to be communicatively coupled to the card edge connector 112. The upper and lower module circuit cards 300, 400 are accessible at a mating end of the pluggable module 106 for mating with the card edge connector 112.

The pluggable module 106 includes a pluggable body 200 holding the upper and lower cable assemblies 210, 212. The pluggable body 200 is defined by one or more shells. The pluggable body 200 may be thermally conductive and/or may be electrically conductive, such as to provide EMI shielding for the upper and lower cable assemblies 210, 212. The pluggable body 200 includes a mating end 202 and an opposite cable end 204. The mating end 202 is configured to be inserted into the corresponding module channel 118. The cable end 204 has the cables 214, 216 extending therefrom, which may be routed to another component or another pluggable module 106 within the communication system 100.

The pluggable module 106 includes an outer perimeter defining an exterior of the pluggable body 200. For example, the outer perimeter may be defined by a top 220, a bottom 222, a first side 224 and a second side 226. The pluggable body 200 may have other shapes in alternative embodiments. In an exemplary embodiment, the pluggable body 200 provides heat transfer for components of the pluggable module 106. In an exemplary embodiment, the pluggable body 200 includes an upper shell 230 and a lower shell 232. The upper and lower shells 230, 232 are joined, such as along the sides 224, 226. The upper and lower shells 230, 232 may be die cast shells. In alternative embodiments, the upper and lower shells 230, 232 may be stamped and formed shells. The upper and lower shells 230, 232 define a cavity 234. The cavity 234 may be defined by the top 220, the bottom 222, the first side 224 and the second side 226.

In an exemplary embodiment, the pluggable module 106 includes a latch 236 for securing the pluggable module 106 to the receptacle cage 110. The latch 236 includes one or more latching fingers 238 configured to be latchably secured to the receptacle cage 110. In various embodiments, the latch 236 includes a pull tab for actuating the latch 236. The latch 236 may be actuated by other devices in alternative embodiments. In the illustrated embodiment, the latch 236 is provided at the top 220; however, the latch 236 may be provided at other locations, such as the bottom 222 or the sides 224, 226.

Figure 4:
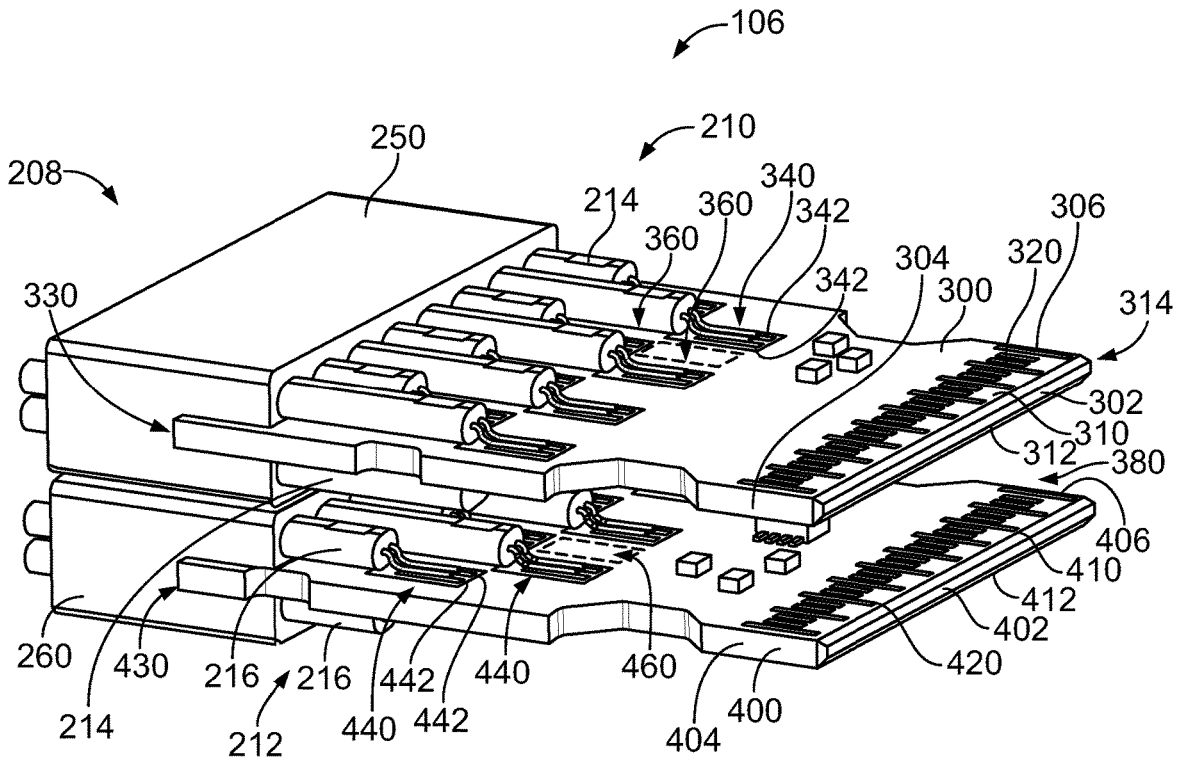
FIG. 4 is a top perspective view of a portion of the pluggable module showing the cable assembly and the module circuit cards of the pluggable module in accordance with an exemplary embodiment.
Figure 5:
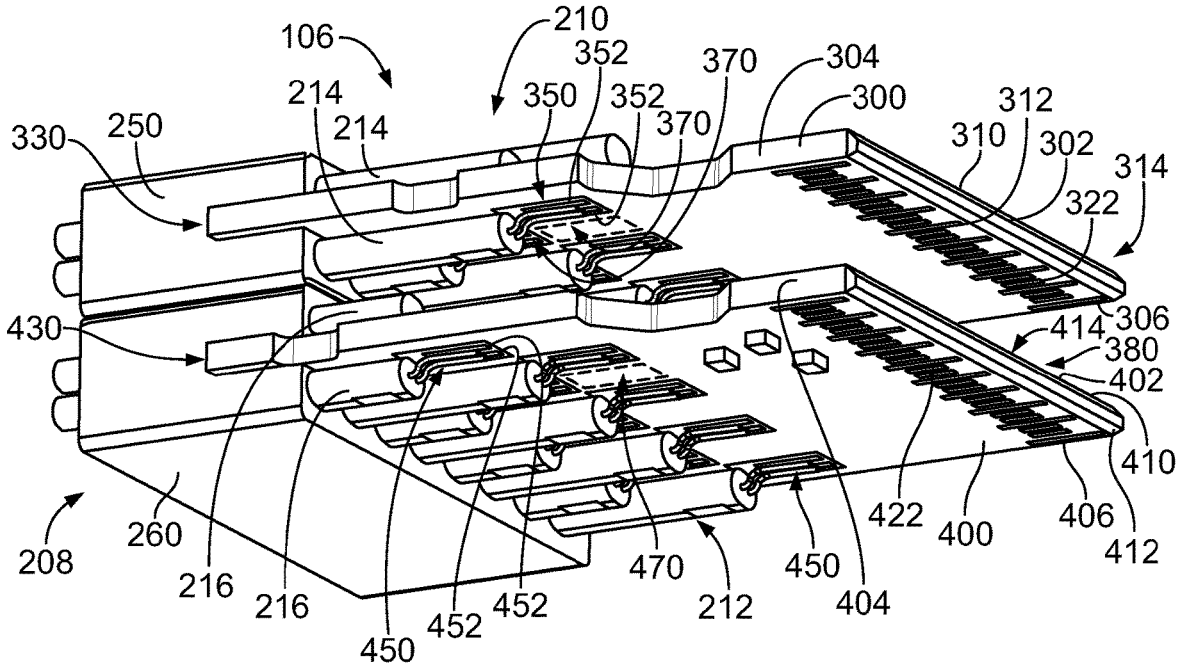
FIG. 5 is a bottom perspective view of a portion of the pluggable module showing the cable assembly and the module circuit cards of the pluggable module in accordance with an exemplary embodiment.

FIG. 4 is a top perspective view of a portion of the pluggable module 106 showing the cable assembly 208 and the module circuit cards 300, 400 of the pluggable module 106. FIG. 5 is a bottom perspective view of a portion of the pluggable module 106 showing the cable assembly 208 and the module circuit cards 300, 400 of the pluggable module 106. The pluggable body 200 (FIG. 3) is removed to illustrate the upper and lower cable assemblies 210, 212. In an exemplary embodiment, the pluggable module 106 is a dual circuit card module. The pluggable module 106 includes the upper module circuit card 300 and the lower module circuit card 400. The upper and lower module circuit cards 300, 400 are configured to be communicatively coupled to the card edge connector 112. The upper and lower module circuit cards 300, 400 are accessible at the mating end 202. Optionally, the upper and lower cable assemblies 210, 212 may be similar to each other, such as being identical, mirrored or inverted relative to each other.

In an exemplary embodiment, the upper cable assembly 210 includes a holder 250 holding the upper module circuit card 300 and the upper cables 214 associated with the upper module circuit card 300. The holder 250 is a dielectric holder, such as being manufactured from a plastic material. The holder 250 may be formed in place on the upper module circuit card 300. For example, the holder 250 may be molded in situ on the upper module circuit card 300. The holder 250 may be molded around the upper cables 214 to provide strain relief for the upper cables 214. In other embodiments, the holder 250 may be separately manufactured and the upper module circuit card 300 may be inserted into the holder 250. The holder 250 is configured to be received in the pluggable body 200 to hold the upper module circuit card 300 within the cavity 234 of the pluggable body 200. The holder 250 may be used to position the upper module circuit card 300 relative to the lower module circuit card 400.

The upper module circuit card 300 has a card edge 302 extending between a first side 304 and a second side 306 of the upper module circuit card 300. The upper module circuit card 300 includes a first or upper surface 310 and a second or lower surface 312 at a mating end 314 of the upper module circuit card 300. The upper module circuit card 300 includes first upper contact pads 320 on the first surface 310 of the upper module circuit card 300 and second upper contact pads 322 on the second surface 312 of the upper module circuit card 300. The upper contact pads 320, 322 may be pads or circuits at the card edge 302 configured to be mated with the card edge connector 112. The upper module circuit card 300 may include components, circuits and the like used for operating and/or using the pluggable module 106. For example, the upper module circuit card 300 may have conductors, traces, pads, electronics, sensors, controllers, switches, inputs, outputs, and the like to form various circuits. The upper contact pads 320, 322 may be high speed signal pads, low speed or sideband signal pads, ground pads, and the like. In an exemplary embodiment, the upper contact pads 320, 322 may be arranged in pairs configured to convey differential signals with pairs of the signal contacts separated by ground contacts. Other arrangements are possible in alternative embodiments.

The upper cables 214 are terminated to the upper module circuit card 300 at a cable edge 330 of the upper module circuit card 300. The upper module circuit card 300 includes first upper cable termination areas 340 on the first surface 310 of the upper module circuit card 300 and second upper cable termination areas 350 on the second surface 312 of the upper module circuit card 300. The upper module circuit card 300 includes first upper cable pads 342 on the first surface 310 of the upper module circuit card 300 and second upper cable pads 352 on the second surface 312 of the upper module circuit card 300. The first upper cable pads 342 are located at the first upper cable termination areas 340. The second upper cable pads 352 are located at the second upper cable termination areas 350. The upper cable pads 342, 352 may be pads or circuits at the cable edge 330. The upper cables 214 are electrically connected to the upper module circuit card 300 at the upper cable pads 342, 352. In an exemplary embodiment, each upper cable termination area 340, 350 includes a pair of corresponding upper cable pads 342, 352. However, greater or fewer upper cable pads 342, 352 may be provided in alternative embodiments.

In an exemplary embodiment, the upper module circuit card 300 includes first upper cable voids 360 on the first surface 310 between the first upper cable termination areas 340. The first upper cable voids 360 and the first upper cable termination areas 340 are alternating across the upper module circuit card 300 between the first and second sides 304, 306. The first upper cable voids 360 are devoid of cable pads. None of the upper cables 214 are terminated to the upper module circuit card 300 at the first upper cable voids 360. In an exemplary embodiment, the upper module circuit card 300 includes second upper cable voids 370 on the second surface 312 between the second upper cable termination areas 350. The second upper cable voids 370 and the second upper cable termination areas 350 are alternating across the upper module circuit card 300 between the first and second sides 304, 306. The second upper cable voids 370 are devoid of cable pads. None of the upper cables 214 are terminated to the upper module circuit card 300 at the second upper cable voids 370. Cross-talk is reduced by separating or spacing apart the cable termination areas 340, 350 and providing the cable voids 360, 370 between the cable termination areas 340, 350, which improves signal integrity through the pluggable module 106.

In an exemplary embodiment, adjacent first upper cable termination areas 340 are staggered relative to each other (for example, forward/rearward staggering) and adjacent second upper cable termination areas 350 are staggered relative to each other (for example, forward/rearward staggering). Similarly, adjacent first upper cable voids 360 are staggered relative to each other (for example, forward/rearward staggering) and adjacent second upper cable voids 370 are staggered relative to each other (for example, forward/rearward staggering). The first upper cable termination areas 340 are staggered at different depths from the cable edge 330 of the upper module circuit card 300 and the second upper cable termination areas 350 are staggered at different depths from the cable edge 330 of the upper module circuit card 300. Cross-talk is reduced by staggering the cable termination areas 340, 350 to improve signal integrity through the pluggable module 106. In an exemplary embodiment, the first upper cable termination areas 340 are arranged in a first row and a second row across the first surface 310 of the upper module circuit card 300 and the second upper cable termination areas 350 are arranged in a first row and a second row across the second surface 312 of the upper module circuit card 300.

In an exemplary embodiment, the first upper cable termination areas 340 are aligned with corresponding second upper cable termination areas 350 on the opposite first and second surfaces 310, 312 of the upper module circuit card 300. Similarly, the first upper cable voids 360 are aligned with corresponding second upper cable voids 370 on the opposite first and second surfaces 310, 312 of the upper module circuit card 300. In an exemplary embodiment, the first upper cable voids 360 are axially aligned with corresponding first upper cable termination areas 340 and the second upper cable voids 370 are axially aligned with corresponding second upper cable termination areas 350, such as in first and second rows. In an exemplary embodiment, the first upper cable voids 360 and the first upper cable termination areas 340 are aligned in columns and rows (8 columns and 2 rows in the illustrated embodiment) and the second upper cable voids 370 and the second upper cable termination areas 350 are aligned in columns and rows (8 columns and 2 rows in the illustrated embodiment).

In an exemplary embodiment, the lower cable assembly 212 includes a holder 260 holding the lower module circuit card 400 and the lower cables 216 associated with the lower module circuit card 400. The holder 260 is a dielectric holder, such as being manufactured from a plastic material. The holder 260 may be formed in place on the lower module circuit card 400. For example, the holder 260 may be molded in situ on the lower module circuit card 400. The holder 260 may be molded around the lower cables 216 to provide strain relief for the lower cables 216. In other embodiments, the holder 260 may be separately manufactured and the lower module circuit card 400 may be inserted into the holder 260. The holder 260 is configured to be received in the pluggable body 200 to hold the lower module circuit card 400 within the cavity 234 of the pluggable body 200. The holder 260 may be used to position the lower module circuit card 400 relative to the lower module circuit card 400.

The lower module circuit card 400 has a card edge 402 extending between a first side 404 and a second side 406 of the lower module circuit card 400. The lower module circuit card 400 includes a first or upper surface 410 and a second or lower surface 412 at a mating end 414 of the lower module circuit card 400. The lower module circuit card 400 includes first lower contact pads 420 on the first surface 410 of the lower module circuit card 400 and second lower contact pads 422 on the second surface 412 of the lower module circuit card 400. The lower contact pads 420, 422 may be pads or circuits at the card edge 402 configured to be mated with the card edge connector 112. The lower module circuit card 400 may include components, circuits and the like used for operating and/or using the pluggable module 106. For example, the lower module circuit card 400 may have conductors, traces, pads, electronics, sensors, controllers, switches, inputs, outputs, and the like to form various circuits. The lower contact pads 420, 422 may be high speed signal pads, low speed or sideband signal pads, ground pads, and the like. In an exemplary embodiment, the lower contact pads 420, 422 may be arranged in pairs configured to convey differential signals with pairs of the signal contacts separated by ground contacts. Other arrangements are possible in alternative embodiments.

The lower cables 216 are terminated to the lower module circuit card 400 at a cable edge 430 of the lower module circuit card 400. The lower module circuit card 400 includes first lower cable termination areas 440 on the first surface 410 of the lower module circuit card 400 and second lower cable termination areas 450 on the second surface 412 of the lower module circuit card 400. The lower module circuit card 400 includes first lower cable pads 442 on the first surface 410 of the lower module circuit card 400 and second lower cable pads 452 on the second surface 412 of the lower module circuit card 400. The first lower cable pads 442 are located at the first lower cable termination areas 440. The second lower cable pads 452 are located at the second lower cable termination areas 450. The lower cable pads 442, 452 may be pads or circuits at the cable edge 430. The lower cables 216 are electrically connected to the lower module circuit card 400 at the lower cable pads 442, 452. In an exemplary embodiment, each lower cable termination area 440, 450 includes a pair of corresponding lower cable pads 442, 452. However, greater or fewer lower cable pads 442, 452 may be provided in alternative embodiments.

In an exemplary embodiment, the lower module circuit card 400 includes first lower cable voids 460 on the first surface 410 between the first lower cable termination areas 440. The first lower cable voids 460 and the first lower cable termination areas 440 are alternating across the lower module circuit card 400 between the first and second sides 404, 406. The first lower cable voids 460 are devoid of cable pads. None of the lower cables 216 are terminated to the lower module circuit card 400 at the first lower cable voids 460. In an exemplary embodiment, the lower module circuit card 400 includes second lower cable voids 470 on the second surface 412 between the second lower cable termination areas 450. The second lower cable voids 470 and the second lower cable termination areas 450 are alternating across the lower module circuit card 400 between the first and second sides 404, 406. The second lower cable voids 470 are devoid of cable pads. None of the lower cables 216 are terminated to the lower module circuit card 400 at the second lower cable voids 470. Cross-talk is reduced by separating or spacing apart the cable termination areas 440, 450 and providing the cable voids 460, 470 between the cable termination areas 440, 450, which improves signal integrity through the pluggable module 106.

In an exemplary embodiment, adjacent first lower cable termination areas 440 are staggered relative to each other (for example, forward/rearward staggering) and adjacent second lower cable termination areas 450 are staggered relative to each other (for example, forward/rearward staggering). Similarly, adjacent first lower cable voids 460 are staggered relative to each other (for example, forward/rearward staggering) and adjacent second lower cable voids 470 are staggered relative to each other (for example, forward/rearward staggering). The first lower cable termination areas 440 are staggered at different depths from the cable edge 430 of the lower module circuit card 400 and the second lower cable termination areas 450 are staggered at different depths from the cable edge 430 of the lower module circuit card 400. Cross-talk is reduced by staggering the cable termination areas 440, 450 to improve signal integrity through the pluggable module 106. In an exemplary embodiment, the first lower cable termination areas 440 are arranged in a first row and a second row across the first surface 410 of the lower module circuit card 400 and the second lower cable termination areas 450 are arranged in a first row and a second row across the second surface 412 of the lower module circuit card 400.

In an exemplary embodiment, the first lower cable termination areas 440 are aligned with corresponding second lower cable termination areas 450 on the opposite first and second surfaces 410, 412 of the lower module circuit card 400. Similarly, the first lower cable voids 460 are aligned with corresponding second lower cable voids 470 on the opposite first and second surfaces 410, 412 of the lower module circuit card 400. In an exemplary embodiment, the first lower cable voids 460 are axially aligned with corresponding first lower cable termination areas 440 and the second lower cable voids 470 are axially aligned with corresponding second lower cable termination areas 450, such as in first and second rows. In an exemplary embodiment, the first lower cable voids 460 and the first lower cable termination areas 440 are aligned in columns and rows (8 columns and 2 rows in the illustrated embodiment) and the second lower cable voids 470 and the second lower cable termination areas 450 are aligned in columns and rows (8 columns and 2 rows in the illustrated embodiment).

In an exemplary embodiment, the upper and lower module circuit cards 300, 400 are spaced apart across a card gap 380. The lower surface 312 of the upper module circuit card 300 faces the upper surface 410 of the lower module circuit card 400 across the card gap 380. The upper and lower module circuit cards 300, 400 are parallel to each other and may both be oriented horizontally in various embodiments. In an exemplary embodiment, the second upper cable termination areas 350 are offset relative to the first lower cable termination areas 440 across the card gap 380. For example, the second upper cable termination areas 350 are aligned with the first lower cable voids 460 across the card gap 380 and the second upper cable voids 370 are aligned with the first lower cable termination areas 440 across the card gap 380. Cross-talk is reduced by having the second upper cable termination areas 350 and the first lower cable termination areas 440 offset across the card gap 380 to improve signal integrity through the pluggable module 106.

Figure 6:
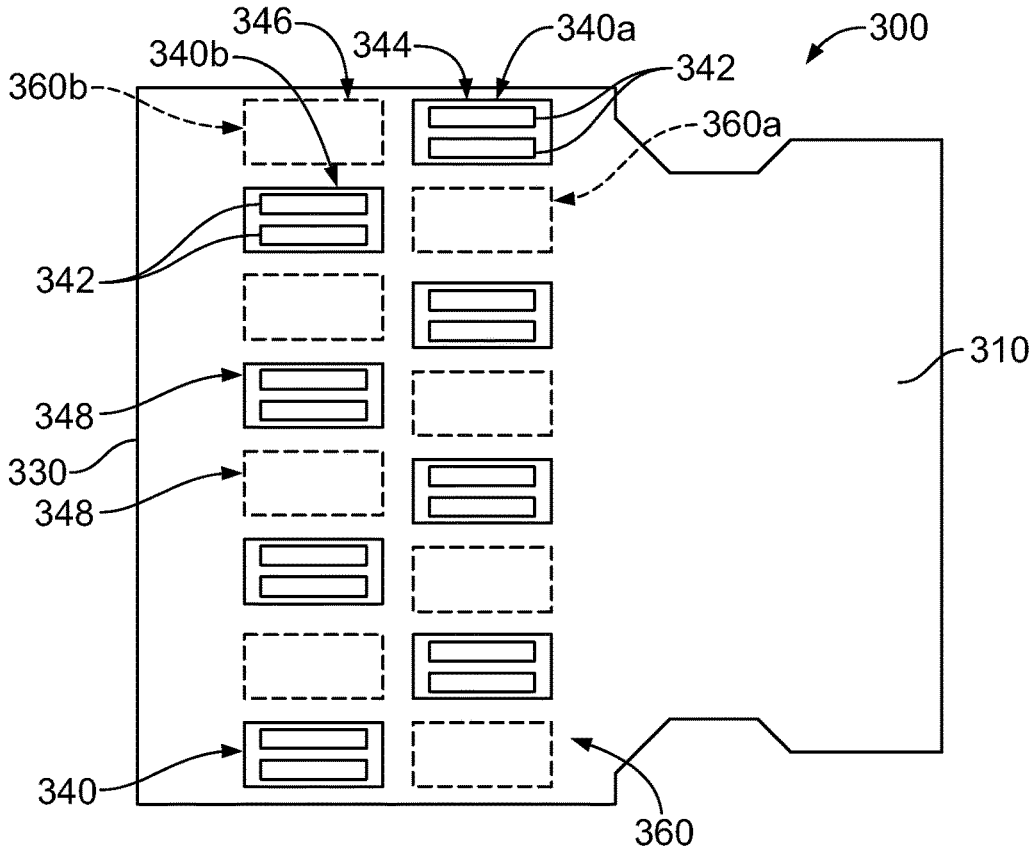
FIG. 6 is a top view of the upper module circuit card in accordance with an exemplary embodiment.
Figure 7:
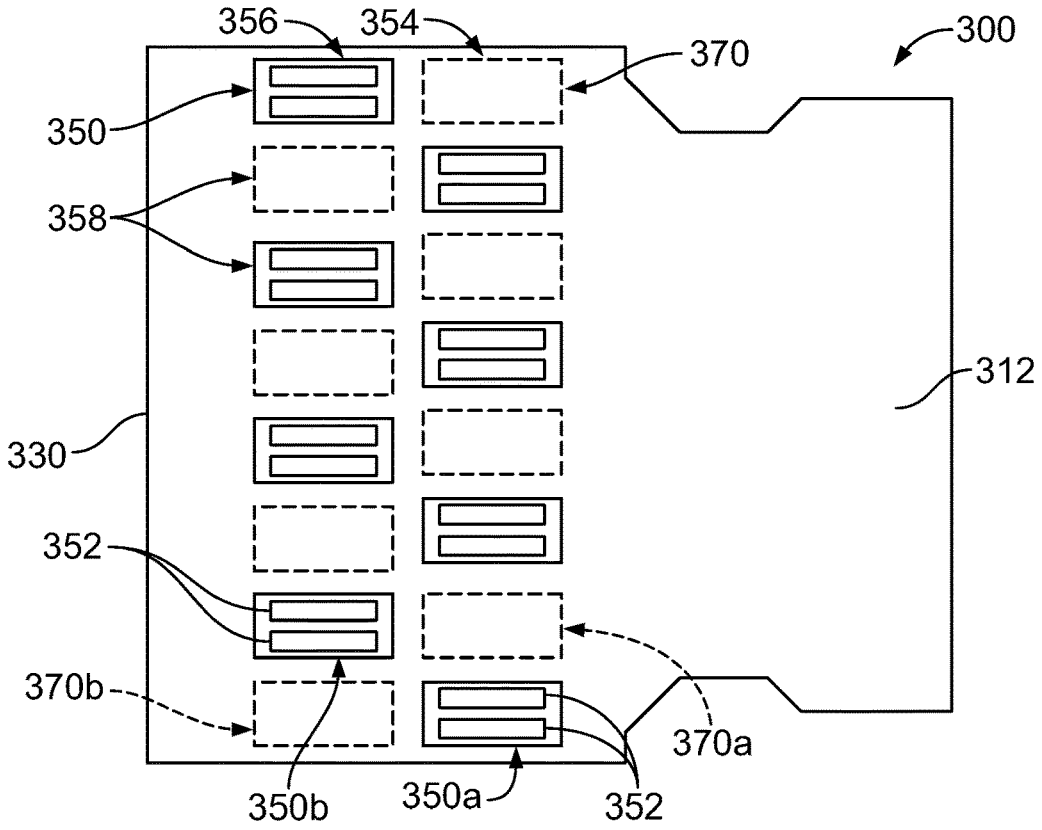
FIG. 7 is a bottom view of the upper module circuit card in accordance with an exemplary embodiment.
Figure 8:
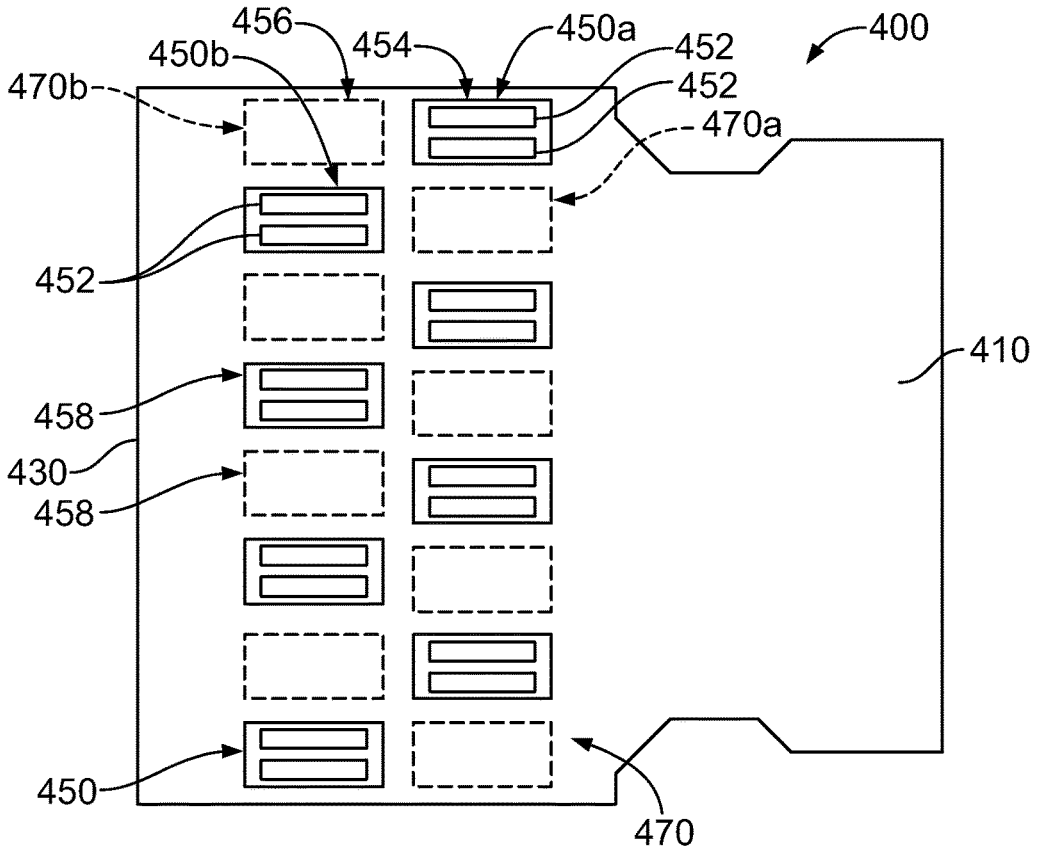
FIG. 8 is a top view of the lower module circuit card in accordance with an exemplary embodiment.
Figure 9:
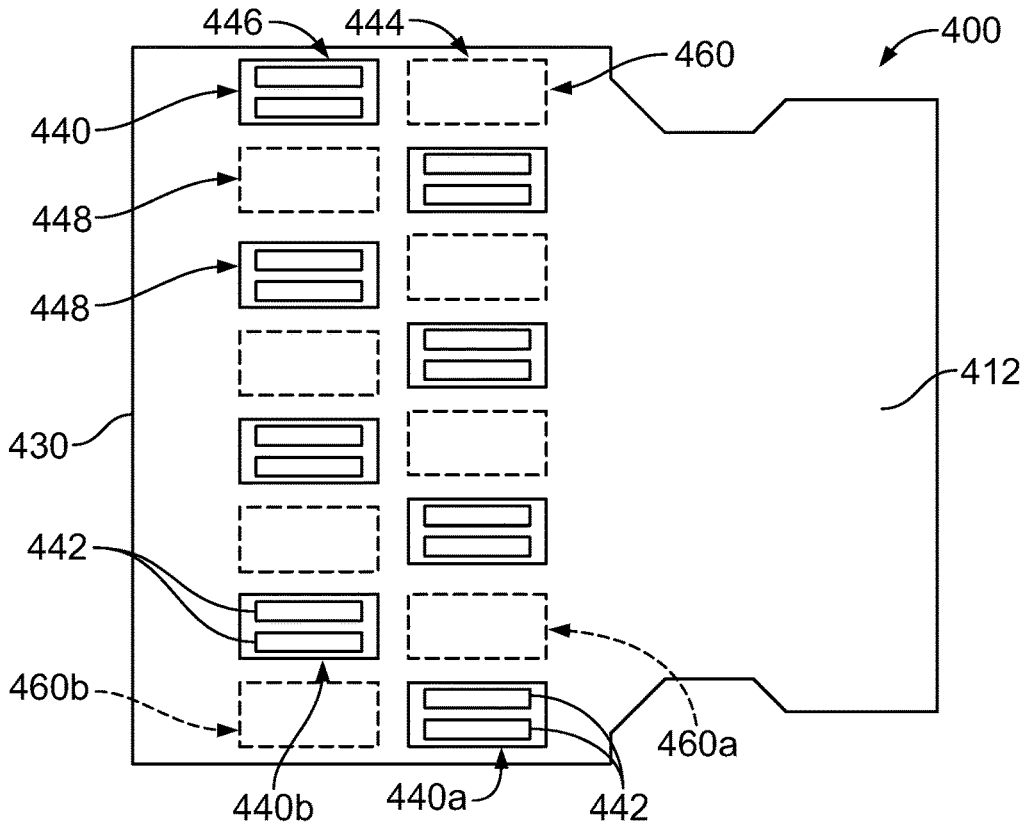
FIG. 9 is a bottom view of the lower module circuit card in accordance with an exemplary embodiment.

FIG. 6 is a top view of the upper module circuit card 300 in accordance with an exemplary embodiment. FIG. 7 is a bottom view of the upper module circuit card 300 in accordance with an exemplary embodiment. FIG. 8 is a top view of the lower module circuit card 400 in accordance with an exemplary embodiment. FIG. 9 is a bottom view of the lower module circuit card 400 in accordance with an exemplary embodiment. FIG. 6 shows the first or upper surface 310 of the upper module circuit card 300 while FIG. 7 shows the second or lower surface 312 of the upper module circuit card 300. FIG. 8 shows the first or upper surface 410 of the lower module circuit card 400 while FIG. 9 shows the second or lower surface 412 of the lower module circuit card 400.

With reference to FIG. 6, the first upper cable termination areas 340 are staggered relative to each other to position the first upper cable pads 342 at different depths from the cable edge 330. Similarly, the first upper cable voids 360 are staggered relative to each other at different depths form the cable edge 330 between the first upper cable termination areas 340. The first upper cable termination areas 340 define forward first upper cable termination areas 340*a* and rearward first upper cable termination areas 340*b*. The forward first upper cable termination areas 340*a* are located in a first row 344 and the rearward first upper cable termination areas 340*b* are located in a second row 346 rearward of the first row 344 (for example, closer to the rear end or cable end of the upper module circuit card 300). The first upper cable voids 360 define forward first upper cable voids 360*a* and rearward first upper cable voids 360*b* axially aligned with the forward first upper cable termination areas 340*a* and the rearward first upper cable termination areas 340*b* in the first and second rows 344, 346, respectively. In an exemplary embodiment, the forward first upper cable termination areas 340*a* are aligned with the rearward first upper cable voids 360*b* in columns 348 and the rearward first upper cable termination areas 340*b* are aligned with the forward first upper cable voids 360*a* in the columns 348. Cross-talk is reduced by interspersing the forward and rearward first upper cable voids 360*a*, 360*b* with the forward and rearward first upper cable termination areas 340*a*, 340*b* to improve signal integrity through the pluggable module 106.

With reference to FIG. 7, the second upper cable termination areas 350 are staggered relative to each other to position the second upper cable pads 352 at different depths from the cable edge 330. Similarly, the second upper cable voids 370 are staggered relative to each other at different depths form the cable edge 330 between the second upper cable termination areas 350. The second upper cable termination areas 350 define forward second upper cable termination areas 350*a* and rearward second upper cable termination areas 350*b*. The forward second upper cable termination areas 350*a* are located in a first row 354 and the rearward second upper cable termination areas 350*b* are located in a second row 356 rearward of the first row 354 (for example, closer to the rear end or cable end of the upper module circuit card 300). The second upper cable voids 370 define forward second upper cable voids 370*a* and rearward second upper cable voids 370*b* axially aligned with the forward second upper cable termination areas 350*a* and the rearward first upper cable termination areas 350*b* in the first and second rows 354, 356, respectively. In an exemplary embodiment, the forward second upper cable termination areas 350*a* are aligned with the rearward second upper cable voids 370*b* in columns 358 and the rearward second upper cable termination areas 350*b* are aligned with the forward second upper cable voids 370*a* in the columns 358. Cross-talk is reduced by interspersing the forward and rearward second upper cable voids 370*a*, 370*b* with the forward and rearward second upper cable termination areas 350*a*, 350*b* to improve signal integrity through the pluggable module 106.

With reference to FIG. 8, the first lower cable termination areas 440 are staggered relative to each other to position the first lower cable pads 442 at different depths from the cable edge 430. Similarly, the first lower cable voids 460 are staggered relative to each other at different depths form the cable edge 430 between the first lower cable termination areas 440. The first lower cable termination areas 440 define forward first lower cable termination areas 440*a* and rearward first lower cable termination areas 440*b*. The forward first lower cable termination areas 440*a* are located in a first row 444 and the rearward first lower cable termination areas 440*b* are located in a second row 446 rearward of the first row 444 (for example, closer to the rear end or cable end of the lower module circuit card 400). The first lower cable voids 460 define forward first lower cable voids 460*a* and rearward first lower cable voids 460*b* axially aligned with the forward first lower cable termination areas 440*a* and the rearward first upper cable termination areas 440*b* in the first and second rows 444, 446, respectively. In an exemplary embodiment, the forward first lower cable termination areas 440*a* are aligned with the rearward first lower cable voids 460*b* in columns 448 and the rearward first lower cable termination areas 440*b* are aligned with the forward first lower cable voids 460*a* in the columns 448. Cross-talk is reduced by interspersing the forward and rearward first lower cable voids 460*a*, 460*b* with the forward and rearward first lower cable termination areas 440*a*, 440*b* to improve signal integrity through the pluggable module 106.

With reference to FIG. 9, the second lower cable termination areas 450 are staggered relative to each other to position the second lower cable pads 452 at different depths from the cable edge 430. Similarly, the second lower cable voids 470 are staggered relative to each other at different depths form the cable edge 430 between the second lower cable termination areas 450. The second lower cable termination areas 450 define forward second lower cable termination areas 450*a* and rearward second lower cable termination areas 450*b*. The forward second lower cable termination areas 450*a* are located in a first row 454 and the rearward second lower cable termination areas 450*b* are located in a second row 456 rearward of the first row 454 (for example, closer to the rear end or cable end of the lower module circuit card 400). The second lower cable voids 470 define forward second lower cable voids 470*a* and rearward second lower cable voids 470*b* axially aligned with the forward second lower cable termination areas 450*a* and the rearward second lower cable termination areas 450*b* in the first and second rows 454, 456, respectively. In an exemplary embodiment, the forward second lower cable termination areas 450*a* are aligned with the rearward second lower cable voids 470*b* in columns 458 and the rearward second lower cable termination areas 450*b* are aligned with the forward second lower cable voids 470*a* in the columns 458. Cross-talk is reduced by interspersing the forward and rearward second lower cable voids 470*a*, 470*b* with the forward and rearward second lower cable termination areas 450*a*, 450*b* to improve signal integrity through the pluggable module 106.

Figure 10:
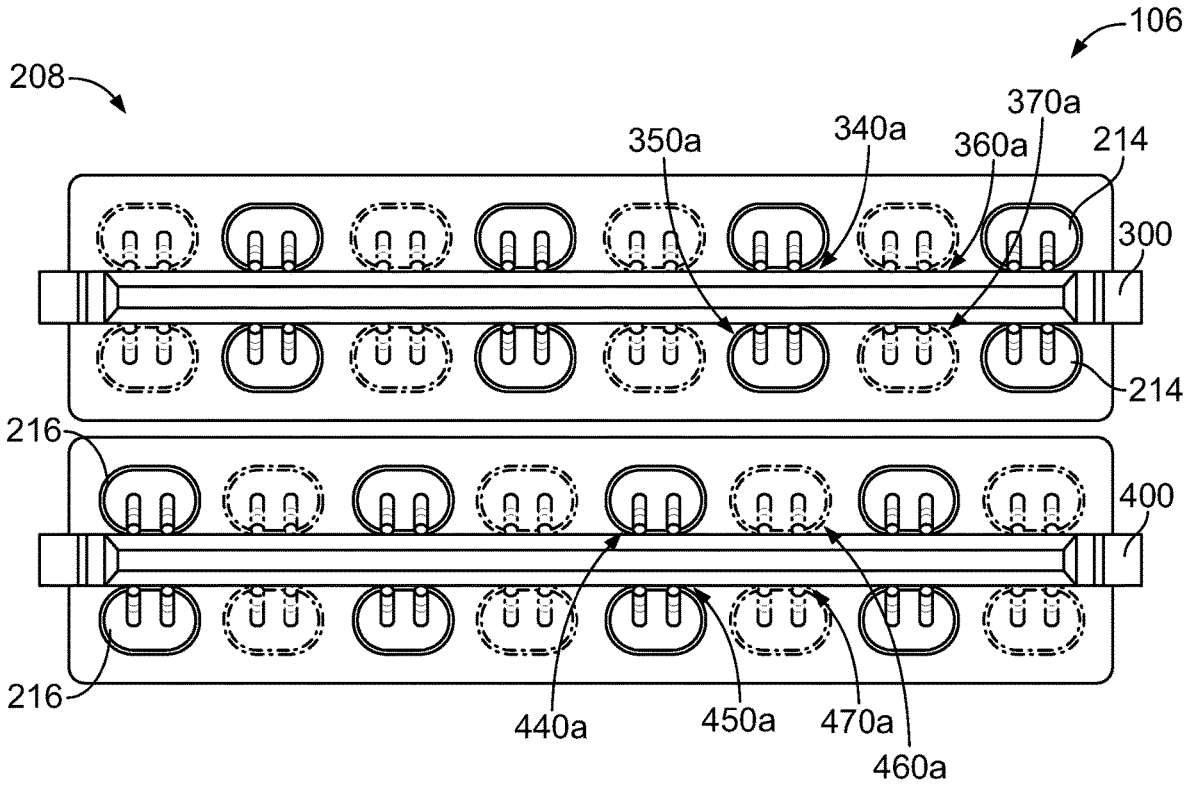
FIG. 10 is a rear view of a portion of the pluggable module showing the cable assembly and the module circuit cards of the pluggable module in accordance with an exemplary embodiment taken along the forward cable termination areas.
Figure 11:
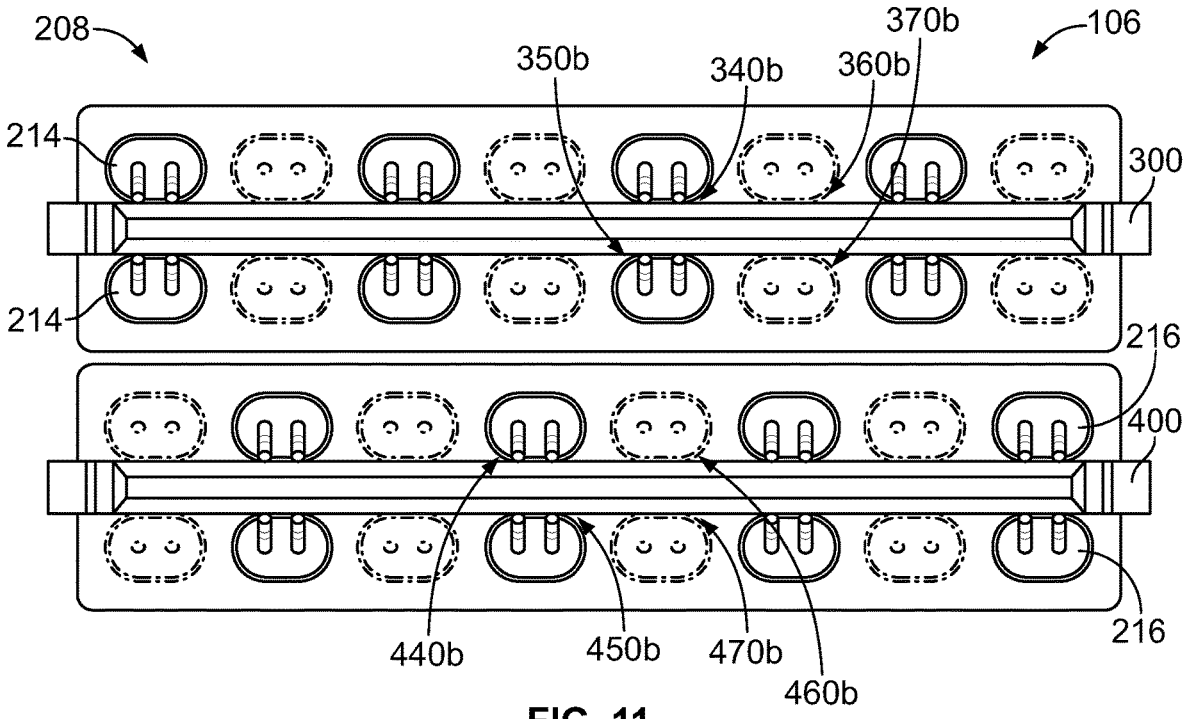
FIG. 11 is a rear view of a portion of the pluggable module showing the cable assembly and the module circuit cards of the pluggable module in accordance with an exemplary embodiment taken along the rearward cable termination areas.

FIG. 10 is a rear view of a portion of the pluggable module 106 showing the cable assembly 208 and the module circuit cards 300, 400 of the pluggable module 106 in accordance with an exemplary embodiment taken along the forward cable termination areas 340*a*, 350*a*, 440*a*, 450*a*. FIG. 11 is a rear view of a portion of the pluggable module 106 showing the cable assembly 208 and the module circuit cards 300, 400 of the pluggable module 106 in accordance with an exemplary embodiment taken along the rearward cable termination areas 340*b*, 350*b*, 440*b*, 450*b*. The structure of the module circuit cards 300, 400 staggers the termination locations of the cables 214, 216 in X, Y and Z directions for improved signal performance. The structure of the module circuit cards 300, 400 staggers the termination locations of the cables 214, 216 in X, Y and Z directions for improved trace routing. In an exemplary embodiment, the termination location pattern of the upper module circuit card 300 are different than the termination location pattern of the lower module circuit card 400. For example, the termination locations are staggered from the upper module circuit card 300 to the lower module circuit card 400 to provide physical separation (spacing) therebetween and to reduce cross-talk. For example, the stacked module circuit cards 300, 400 have different alternating patterns of termination locations to help reduce crosstalk between the module circuit cards (for example, having the lower module circuit card 400 start with a termination area moved forward at the left-most side and then having the upper module circuit card 300 start with a termination area moved rearward at the left-most side).

The upper cables 214 are terminated to the upper module circuit card 300 at the forward cable termination areas 340*a*, 350*a* (FIG. 10) and at the rearward cable termination areas 340*b*, 350*b* (FIG. 11). The forward upper cable voids 360*a*, 370*a* are located between the forward cable termination areas 340*a*, 350*a* to space or separate the upper cables 214 from each other, such as to reduce cross-talk and improved signal integrity. The rearward upper cable voids 360*b*, 370*b* are located between the rearward cable termination areas 340*b*, 350*b* to space or separate the upper cables 214 from each other, such as to reduce cross-talk and improved signal integrity.

The lower cables 216 are terminated to the lower module circuit card 400 at the forward cable termination areas 440*a*, 450*a* (FIG. 10) and at the rearward cable termination areas 440*b*, 450*b* (FIG. 11). The forward lower cable voids 460*a*, 470*a* are located between the forward cable termination areas 440*a*, 450*a* to space or separate the lower cables 214 from each other, such as to reduce cross-talk and improved signal integrity. The rearward lower cable voids 460*b*, 470*b* are located between the rearward cable termination areas 440*b*, 450*b* to space or separate the lower cables 214 from each other, such as to reduce cross-talk and improved signal integrity.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A pluggable module comprising a pluggable body having a top wall, a bottom wall, a first side wall and a second side wall, the pluggable body having a cavity, the pluggable body extending between a mating end and a cable end;

an upper module circuit card received in the cavity, the upper module circuit card having a mating edge at a mating end configured to be loaded into an upper card slot of a card edge connector and a cable end opposite the mating end, the upper module circuit card including first upper contact pads on an upper surface of the upper module circuit card at the mating end, the upper module circuit card including second upper contact pads on a lower surface of the upper module circuit card at the mating end, the upper module circuit card including first upper cable termination areas on the upper surface of the upper module circuit card at the cable end, the upper module circuit card including second upper cable termination areas on the lower surface of the upper module circuit card at the cable end, the first upper cable termination areas including first upper cable pads electrically connected to corresponding first upper contact pads, the second upper cable termination areas including second upper cable pads electrically connected to corresponding second upper contact pads;

a lower module circuit card received in the cavity, the lower module circuit card having a mating edge at a mating end configured to be loaded into a lower card slot of a card edge connector and a cable end opposite the mating end, the lower module circuit card including first lower contact pads on an upper surface of the lower module circuit card at the mating end, the lower module circuit card including second lower contact pads on a lower surface of the lower module circuit card at the mating end, the lower module circuit card including first lower cable termination areas on the upper surface of the lower module circuit card at the cable end, the lower module circuit card including second lower cable termination areas on the lower surface of the lower module circuit card at the cable end, the first lower cable termination areas including first lower cable pads electrically connected to corresponding first lower contact pads, the second lower cable termination areas including second lower cable pads electrically connected to corresponding second lower contact pads;

upper cables having upper cable conductors terminated to corresponding first and second upper cable pads; and lower cables having lower cable conductors terminated to corresponding first and second lower cable pads;

wherein adjacent first upper cable termination areas are staggered relative to each other, adjacent second upper cable termination areas are staggered relative to each other, adjacent first lower cable termination areas are staggered relative to each other, and adjacent second lower cable termination areas are staggered relative to each other; and wherein the second upper cable termination areas are offset relative to the first lower cable termination areas across a card gap between the upper module circuit card and the lower module circuit card.

2. The pluggable module of claim 1, wherein the first upper cable termination areas are staggered at different depths from a cable edge of the upper module circuit card, the second upper cable termination areas are staggered at different depths from the cable edge of the upper module circuit card, the first lower cable termination areas are staggered at different depths from a cable edge of the lower module circuit card, and the second lower cable termination areas are staggered at different depths from the cable edge of the lower module circuit card.

3. The pluggable module of claim 1, wherein the upper cable conductors are arranged in differential pairs and the lower cable conductors are arranged in differential pairs, each first upper cable termination area including a pair of the first upper cable pads, each first lower cable termination area including a pair of the first lower cable pads, each first lower cable termination area including a pair of the first lower cable pads, and each second lower cable termination area including a pair of the second lower cable pads.

4. The pluggable module of claim 1, wherein the first upper cable termination areas are aligned with corresponding second upper cable termination areas on the opposite upper and lower surfaces of the upper module circuit card, and wherein the first lower cable termination areas are aligned with corresponding second lower cable termination areas on the opposite upper and lower surfaces of the lower module circuit card.

5. The pluggable module of claim 1, wherein the first upper cable termination areas are arranged in first and second rows across the upper module circuit card, the second upper cable termination areas are arranged in first and second rows across the upper module circuit card, the first lower cable termination areas are arranged in first and second rows across the lower module circuit card, the second lower cable termination areas are arranged in first and second rows across the lower module circuit card.

6. The pluggable module of claim 1, wherein the first upper cable termination areas include forward first upper cable termination areas and rearward first upper cable termination areas at different depths from each other across the upper module circuit card, the second upper cable termination areas include forward second upper cable termination areas and rearward second upper cable termination areas at different depths from each other across the upper module circuit card, the first lower cable termination areas include forward first lower cable termination areas and rearward first lower cable termination areas at different depths from each other across the lower module circuit card, and the second lower cable termination areas include forward second lower cable termination areas and rearward second lower cable termination areas at different depths from each other across the upper module circuit card.

7. The pluggable module of claim 1, wherein the upper module circuit card include first upper cable voids between the first upper cable termination areas, the upper module circuit card including second upper cable voids between the second upper cable termination areas, the lower module circuit card including first lower cable voids between the first lower cable termination areas, the lower module circuit card including second lower cable voids between the second lower cable termination areas.

8. The pluggable module of claim 7, wherein the first upper cable voids are staggered at different depths from a cable edge of the upper module circuit card, the second upper cable voids are staggered at different depths from the cable edge of the upper module circuit card, the first lower cable voids are staggered at different depths from a cable edge of the lower module circuit card, and the second lower cable voids are staggered at different depths from the cable edge of the lower module circuit card.

9. The pluggable module of claim 7, wherein the first upper cable voids are axially aligned with corresponding first upper cable termination areas, the second upper cable voids are axially aligned with corresponding second upper cable termination areas, the first lower cable voids are axially aligned with corresponding first lower cable termination areas, and the second lower cable voids are axially aligned with corresponding second lower cable termination areas.

10. The pluggable module of claim 7, wherein the first upper cable voids and the first upper cable termination areas are aligned in columns and rows, the second upper cable voids and the second upper cable termination areas are aligned in columns and rows, the first lower cable voids and the first lower cable termination areas are aligned in columns and rows, and the second lower cable voids and the second lower cable termination areas are aligned in columns and rows.

11. The pluggable module of claim 7, wherein the first upper cable termination areas include forward first upper cable termination areas and rearward first upper cable termination areas at different depths from each other across the upper module circuit card, the second upper cable termination areas include forward second upper cable termination areas and rearward second upper cable termination areas at different depths from each other across the upper module circuit card, the first lower cable termination areas include forward first lower cable termination areas and rearward first lower cable termination areas at different depths from each other across the lower module circuit card, and the second lower cable termination areas include forward second lower cable termination areas and rearward second lower cable termination areas at different depths from each other across the upper module circuit card;

wherein the first upper cable voids include forward first upper cable voids and rearward first upper cable voids at different depths from each other across the upper module circuit card, the second upper cable voids include forward second upper cable voids and rearward second upper cable voids at different depths from each other across the upper module circuit card, the first lower cable voids include forward first lower cable voids and rearward first lower cable voids at different depths from each other across the lower module circuit card, and the second lower cable voids include forward second lower cable voids and rearward second lower cable voids at different depths from each other across the upper module circuit card; and wherein the forward first upper cable termination areas are aligned with the forward first upper cable voids in a row and the rearward first upper cable termination areas are aligned with the rearward first upper cable voids in a row, the forward second upper cable termination areas are aligned with the forward second upper cable voids in a row and the rearward second upper cable termination areas are aligned with the rearward second upper cable voids in a row, the forward first lower cable termination areas are aligned with the forward first lower cable voids in a row and the rearward first lower cable termination areas are aligned with the rearward first lower cable voids in a row, and the forward second lower cable termination areas are aligned with the forward second lower cable voids in a row and the rearward second lower cable termination areas are aligned with the rearward second lower cable voids in a row.

12. A pluggable module comprising a pluggable body having a top wall, a bottom wall, a first side wall and a second side wall, the pluggable body having a cavity, the pluggable body extending between a mating end and a cable end;

an upper module circuit card received in the cavity, the upper module circuit card having a mating edge at a mating end configured to be loaded into an upper card slot of a card edge connector and a cable end opposite the mating end, the upper module circuit card including first upper contact pads on an upper surface of the upper module circuit card at the mating end, the upper module circuit card including second upper contact pads on a lower surface of the upper module circuit card at the mating end, the upper module circuit card including first upper cable termination areas on the upper surface of the upper module circuit card at the cable end, the upper module circuit card including second upper cable termination areas on the lower surface of the upper module circuit card at the cable end, the first upper cable termination areas including first upper cable pads electrically connected to corresponding first upper contact pads, the second upper cable termination areas including second upper cable pads electrically connected to corresponding second upper contact pads, wherein adjacent first upper cable termination areas are staggered relative to each other and adjacent second upper cable termination areas are staggered relative to each other;

a lower module circuit card received in the cavity and separated from the upper module circuit card across a card gap, the lower module circuit card having a mating edge at a mating end configured to be loaded into a lower card slot of a card edge connector and a cable end opposite the mating end, the lower module circuit card including first lower contact pads on a lower surface of the lower module circuit card at the mating end, the lower module circuit card including second lower contact pads on a lower surface of the lower module circuit card at the mating end, the lower module circuit card including first lower cable termination areas on the lower surface of the lower module circuit card at the cable end, the lower module circuit card including second lower cable termination areas on the lower surface of the lower module circuit card at the cable end, the first lower cable termination areas including first lower cable pads electrically connected to corresponding first lower contact pads, the second lower cable termination areas including second lower cable pads electrically connected to corresponding second lower contact pads, wherein adjacent first lower cable termination areas are staggered relative to each other and adjacent second lower cable termination areas are staggered relative to each other;

upper cables having upper cable conductors terminated to corresponding first and second upper cable pads; and lower cables having lower cable conductors terminated to corresponding first and second lower cable pads;

wherein the second upper cable termination areas are offset relative to the first lower cable termination areas across the card gap.

13. The pluggable module of claim 12, wherein the first upper cable termination areas are staggered at different depths from a cable edge of the upper module circuit card, the second upper cable termination areas are staggered at different depths from the cable edge of the upper module circuit card, the first lower cable termination areas are staggered at different depths from a cable edge of the lower module circuit card, and the second lower cable termination areas are staggered at different depths from the cable edge of the lower module circuit card.

14. The pluggable module of claim 12, wherein the first upper cable termination areas are aligned with corresponding second upper cable termination areas on the opposite upper and lower surfaces of the upper module circuit card, and wherein the first lower cable termination areas are aligned with corresponding second lower cable termination areas on the opposite upper and lower surfaces of the lower module circuit card.

15. The pluggable module of claim 12, wherein the first upper cable termination areas are arranged in first and second rows across the upper module circuit card, the second upper cable termination areas are arranged in first and second rows across the upper module circuit card, the first lower cable termination areas are arranged in first and second rows across the lower module circuit card, the second lower cable termination areas are arranged in first and second rows across the lower module circuit card.

16. The pluggable module of claim 12, wherein the first upper cable termination areas include forward first upper cable termination areas and rearward first upper cable termination areas at different depths from each other across the upper module circuit card, the second upper cable termination areas include forward second upper cable termination areas and rearward second upper cable termination areas at different depths from each other across the upper module circuit card, the first lower cable termination areas include forward first lower cable termination areas and rearward first lower cable termination areas at different depths from each other across the lower module circuit card, and the second lower cable termination areas include forward second lower cable termination areas and rearward second lower cable termination areas at different depths from each other across the upper module circuit card.

17. The pluggable module of claim 12, wherein the upper module circuit card include first upper cable voids between the first upper cable termination areas, the upper module circuit card including second upper cable voids between the second upper cable termination areas, the lower module circuit card including first lower cable voids between the first lower cable termination areas, the lower module circuit card including second lower cable voids between the second lower cable termination areas.

18. The pluggable module of claim 17, wherein the first upper cable voids are staggered at different depths from a cable edge of the upper module circuit card, the second upper cable voids are staggered at different depths from the cable edge of the upper module circuit card, the first lower cable voids are staggered at different depths from a cable edge of the lower module circuit card, and the second lower cable voids are staggered at different depths from the cable edge of the lower module circuit card.

19. A communication system comprising:

a receptacle connector assembly including a receptacle cage having a cavity and a card edge connector received in the cavity of the receptacle cage, the card edge connector including a housing and a contact assembly received in the housing, the card edge connector including an upper card slot and a lower card slot, upper contacts of the contact assembly provided in the upper card slot, lower contacts of the contact assembly provided in the lower card slot; and a pluggable module pluggable into the cavity of the receptacle cage for mating with the card edge connector, the pluggable module comprising:

a pluggable body having a top wall, a bottom wall, a first side wall and a second side wall, the pluggable body having a cavity, the pluggable body extending between a mating end and a cable end, the mating end being received in the receptacle cage;

an upper module circuit card received in the cavity of the pluggable body, the upper module circuit card having a mating edge at a mating end configured to be loaded into the upper card slot of the card edge connector and a cable end opposite the mating end, the upper module circuit card including first upper contact pads on an upper surface of the upper module circuit card at the mating end, the upper module circuit card including second upper contact pads on a lower surface of the upper module circuit card at the mating end, the first and second upper contact pads being electrically connected to corresponding upper contacts, the upper module circuit card including first upper cable termination areas on the upper surface of the upper module circuit card at the cable end, the upper module circuit card including second upper cable termination areas on the lower surface of the upper module circuit card at the cable end, the first upper cable termination areas including first upper cable pads electrically connected to corresponding first upper contact pads, the second upper cable termination areas including second upper cable pads electrically connected to corresponding second upper contact pads;

a lower module circuit card received in the cavity of the pluggable body, the lower module circuit card having a mating edge at a mating end configured to be loaded into the lower card slot of the card edge connector and a cable end opposite the mating end, the lower module circuit card including first lower contact pads on a lower surface of the lower module circuit card at the mating end, the lower module circuit card including second lower contact pads on a lower surface of the lower module circuit card at the mating end, the first and second lower contact pads being electrically connected to corresponding lower contacts, the lower module circuit card including first lower cable termination areas on the lower surface of the lower module circuit card at the cable end, the lower module circuit card including second lower cable termination areas on the lower surface of the lower module circuit card at the cable end, the first lower cable termination areas including first lower cable pads electrically connected to corresponding first lower contact pads, the second lower cable termination areas including second lower cable pads electrically connected to corresponding second lower contact pads;

upper cables having upper cable conductors terminated to corresponding first and second upper cable pads; and lower cables having lower cable conductors terminated to corresponding first and second lower cable pads;

wherein adjacent first upper cable termination areas are staggered relative to each other, adjacent second upper cable termination areas are staggered relative to each other, adjacent first lower cable termination areas are staggered relative to each other, and adjacent second lower cable termination areas are staggered relative to each other; and wherein the second upper cable termination areas are offset relative to the first lower cable termination areas across a card gap between the upper module circuit card and the lower module circuit card.

* * * * *